United States Patent [19]

Aida et al.

[11] Patent Number: 4,777,892

[45] Date of Patent: Oct. 18, 1988

[54] THREAD CHAIN SEWING METHOD AND DEVICE FOR TWO-NEEDLE OVERLOCK SEWING MACHINE

[75] Inventors: Kikuo Aida; Shingo Iwae, both of Chofu, Japan

[73] Assignee: Tokyo Juki Industrial Co., Ltd., Chofu, Japan

[21] Appl. No.: 878,279

[22] Filed: Jun. 25, 1986

[30] Foreign Application Priority Data

Jun. 29, 1985 [JP] Japan ..... 60-143591

[51] Int. Cl.[4] ..... D05B 1/20

[52] U.S. Cl. ..... 112/162; 112/165

[58] Field of Search ..... 112/162, 172, 163, 288, 112/269.1, 165, 197, 199, 166

[56] References Cited

U.S. PATENT DOCUMENTS

| | | | |
|---|---|---|---|
| 930,369 | 8/1909 | Fefel | 112/260 X |
| 1,940,144 | 1/1932 | Plamondon | 112/162 |
| 3,246,620 | 7/1960 | Sigoda et al. | 112/162 |
| 3,885,509 | 5/1975 | Cox | 112/162 X |
| 4,220,105 | 9/1980 | Palacino | 112/288 X |
| 4,303,030 | 12/1981 | Palacino et al. | 112/186 |
| 4,356,782 | 11/1982 | Ueyama et al. | 112/197 |

*Primary Examiner*—Peter Nerbun

*Attorney, Agent, or Firm*—Morgan & Finnegan

[57] ABSTRACT

A thread chain is prevented from hanging at an inner chain-off finger when it is turned back or rotated to the operator's side for holding and cutting. A needle thread, positioned at the front side of a lower looper, is guided by a needle thread restricting device, and a needle thread positioned on the back side of a lower looper is prevented from being hung on an inner chain-off finger by a thread chain guiding device provided at a throat plate so that enfolding back and tacking of the thread chain into the fabric material is performed well.

3 Claims, 6 Drawing Sheets

THREAD CHAIN SEWING METHOD AND DEVICE FOR TWO-NEEDLE OVERLOCK SEWING MACHINE

BACKGROUND OF THE INVENTION

1. Field of the Invention

This invention relates to a guiding device for a needle thread used for enfolding or back tacking a thread chain by an overedge sewing machine.

2. Description of the Prior Art

When an overedge sewing operation by a conventional overedge sewing machine is finished, a thread chain is formed that extends from the fabric material. Where a two-needle overedge sewing machine is used, after each completion of the overedge sewing process, the thread chain is enfolded or back tacked between the fabric material and the looper threads to prevent the beginning or start edge of the fabric material from fraying. Such an enfolding or back tacking process is well known to those of skill in the art.

Prior art sewing machines have a throat plate, an inner chain-off finger, an outer chain-off finger and a drop point for a right-side needle. The fabric material has a thread chain enfolded or back tacked between the fabric and a looper thread. A thread-chain-holding-and-cutting-device clamps and cuts the thread chain when it is pulled in the direction of feeding.

It is a well-known practice to provide an inner chain-off finger at the throat plate in a prior art overedge sewing machine in order to prevent the fabric material from sinking or dropping stitches by the two needles, to prevent the skipping of stitches, and to make sure the fabric has a good hand or feel.

As used in the art, a "soft chain" means that the thread chain has a well-balanced needle thread and looper thread. When only a thread chain is formed, a thread tension adjuster in the prior art overedge sewing machine regulates the supply of looper thread, thus properly balancing the thread chain with the proper supply of threads, so that a soft chain is produced.

When overedging for each fabric material is finished, the fabric material is released from a presser foot by a pedal action. Then, the thread chain is pulled in the direction of feeding to release the twining threads around the inner chain-off finger and the outer chain-off finger.

The fabric material is next turned back or rotated to the operator's side, and the thread chain is inserted into the thread-chain-holding-and-cutting-device, and the thread chain is cut.

New fabric material is set with a presser foot in a pressing condition, and the stitching starts.

The thread chain is enfolded or back tacked into the seam of the new fabric material.

If the thread chain hangs at the inner chain-off finger, the thread chain is stitched by the needle, and in such case, the thread chain will not be enfolded or back tacked.

The prior art is sometimes effective in preventing the thread chain from hanging at the inner chain-off finger. However, the fabric material is frequently dropped during stitching, and the skipping of stitching is unavoidable. The overedging work is of inferior quality, too.

The mechanical construction of prior art devices is complicated and requires many parts with accurate machinings and is high in cost.

OBJECTS AND SUMMARY OF THE INVENTION

This invention eliminates the above-described defects of the prior art, and includes a thread restricting device that prevents the thread chain from hanging or twining at the inner chain-off finger.

According to first and the second aspects of the present invention, a thread chain, twined around an inner chain-off finger and an outer chain-off finger, is prevented from hanging on the inner chain-off finger when the thread chain is rotated since the needle thread is guided by a needle thread restricting device provided at the lower looper.

According to third and fourth aspects of the present invention, a needle thread, positioned on the operator's side on the back side of the lower looper, is guided by a thread chain guiding device provided at a throat plate so as not to hang on the inner chain-off finger.

DETAILED DESCRIPTION OF THE PREFERRED EMBODIMENTS

Figure 1:
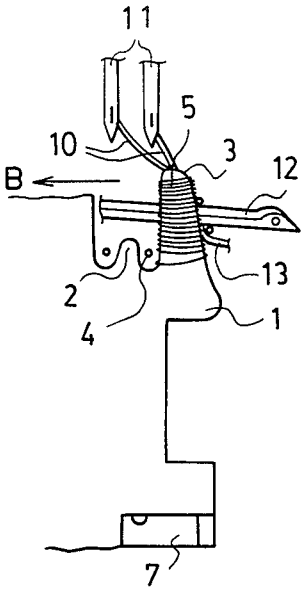
FIG. 1 is a plan view showing the essential parts of first and second embodiments of the present invention.
Figure 2A:
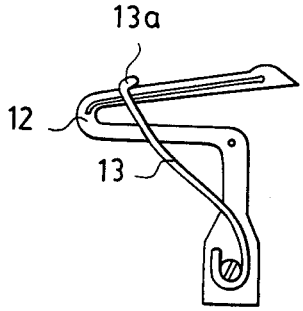
FIG. 2A is a front view of a needle thread restricting device according to the first embodiment.
Figure 2B:
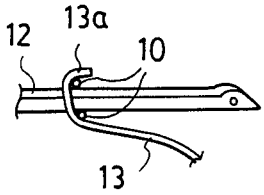
FIG. 2B is a plan view of the embodiment of FIG. 2A.

Referring to the drawings, a first embodiment of the present invention will next be explained. FIG. 1 is a plan view of the embodiment showing the essential parts thereof. FIG. 2A and FIG. 2B illustrate a needle thread restricting device.

A needle thread 10 is threaded into a double needle 11. Reference numeral 12 indicates a lower looper. Reference numeral 13 indicates a needle thread restricting device with a thread restrictor 13*a* at its end. In the illustrated embodiment, device 13 has a generally finger-like shape, with tip 13*a* located adjacent lower looper 12.

Figure 3:
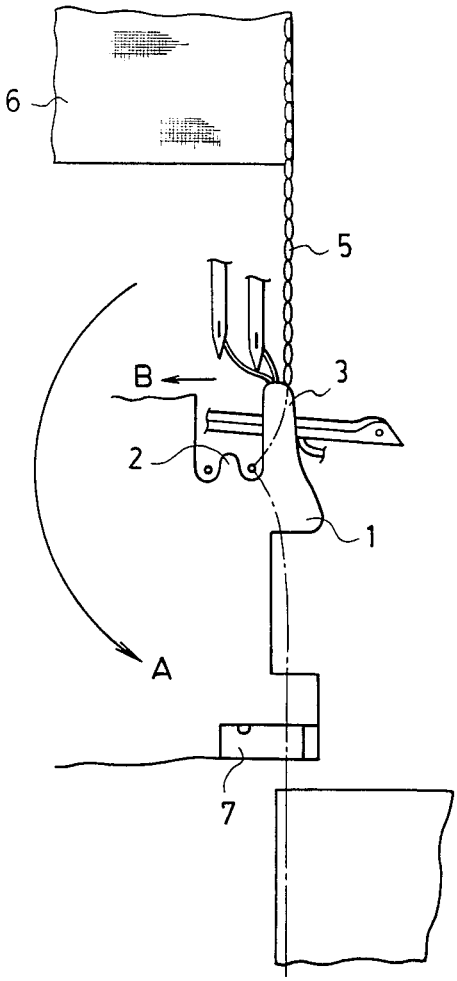
FIG. 3 illustrates the turning back of a thread chain to the operator's side.

FIG. 3 illustrates a thread chain that is pulled in the direction of feeding and is about to be rotated in the direction of arrow "A".

Referring to FIG. 3, the operation of the illustrated embodiment of the invention will next be explained by comparison with a conventional prior art sewing machine. The operation of the prior art sewing machine will be described first.

When overedging is completed, fabric material is released from a presser foot by a pedal action, and fabric material 6 is pulled in the direction of feeding to release a thread chain 5 twined around an inner chain-off finger 2 and an outer chain-off finger 3. Fabric material 6 is turned back (rotated in the direction of arrow "A" in FIG. 3) to the operator's side and thread chain 5 is clamp-cut by a thread-chain-holding-and-cutting-device 7. New fabric material 6 is set, with the presser foot in the lowered position, and stitching is started.

Thread chain 5 is enfolded or back tacked into the subsequent seam. When fabric material 6 is rotated in the direction of arrow "A" in FIG. 3, needle thread 10 in the prior art often hangs or is caught on the inner chain-off finger 2, as hereinbefore described.

Figure 4:
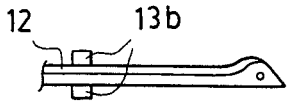
FIG. 4 is a plan view of a needle thread restricting device according to a second embodiment of the invention.

According to the first embodiment of the present invention, when thread chain 5, which twines around inner chain-off finger 2 and outer chain-off finger 3, is pulled in the direction of feeding after the completion of the overedging, thread restrictor 13*a* see (FIG. 2), provided at the end of needle thread restricting device 13, prevents needle thread 10 from moving in the direction of arrows "B" in FIGS. 1 and 3. Thereby, when thread chain 5 is rotated in the direction of arrow "A" in FIG. 3, thread chain 5 is not caught by inner chain-off finger 2 since nedle thread 10 is prevented from sliding downward (FIG. 2A and FIG. 2B). According to the first embodiment, thread restrictor 13*a* is used to prevent needle thread 10 from moving, but it is possible to provide a projection 13*b* on lower looper 12, as illustrated in the second embodiment of FIG. 4. Projection 13*b* is as effective as thread restrictor 13*a* in preventing thread chain 5 from being caught on inner chain-off finger 2.

As aforementioned, the first and second embodiments generally prevent the needle thread from being hung on inner chain-off finger 2. However, there is still a possibility that needle thread 10 will hang on inner chain-off finger 2. Accordingly, needle thread 10, positioned at the back side of lower looper 12, is prevented from hanging at the inner chain-off finger by a thread chain guiding device, as explained more fully below.

Referring to FIGS. 5 A–C and FIGS. 6 A–B, a third embodiment of the present invention will next be explained. A thread chain guiding device 14 is provided at the side wall of throat plate 1. Thread chain guiding device 14 is fixed to the side wall of throat plate 1 and is positioned a little bit farther in the direction of feeding of the material 6 than tip 2*a* of inner chain-off finger 2. Thread chain guiding device 14 comprises an elastic material, such as a plate spring, in the preferred embodiment.

Figure 5A:
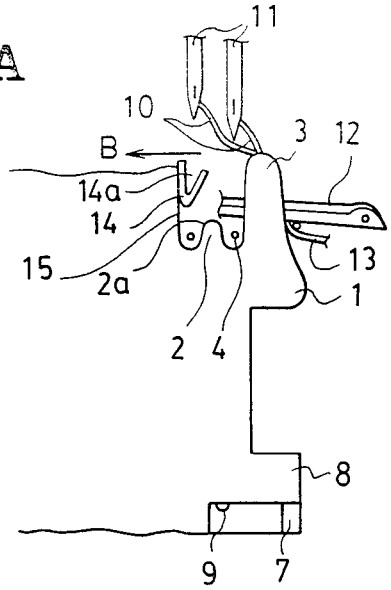
FIG. 5A is a plan view of a thread chain guiding device in accord with a third embodiment of the present invention.
Figures 5B, 5C:
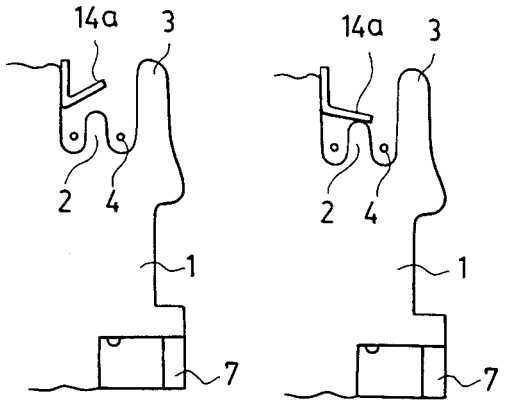
FIGS. 5B–5C illustrate the operation of a thread chain guiding device, with a tip of the thread chain guiding device deflected to the tip of an inner chain-off finger.
Figure 6A:
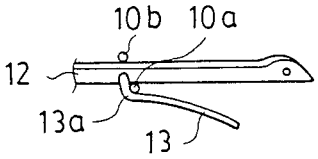
FIG. 6A is a plan view of a needle thread restricting device according to third and fourth embodiments of the present invention.
Figure 6B:
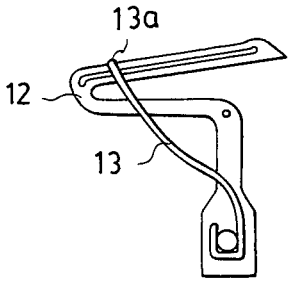
FIG. 6B is a front view of the embodiments of FIG. 6A.

Referring to FIG. 5A, when thread chain 5 is rotated to the operator's side in the direction of arrow "A" in FIG. 3, thread chain 5 hangs or catches on thread chain guiding device 4. Then, thread chain guiding device 14 is pulled and deflected by the thread chain 5 and its free end 14*a* touches tip 2*a* of inner chain-off finger 2 (see FIG. 5C). Thus, thread chain 5 is prevented from being caught by inner chain-off finger 2.

When thread chain 5 is rotated in the direction of arrow "A" in FIG. 3, thread restrictor 13*a* is maintained as the center of rotation. Needle thread 10*a* (see FIG. 6A), positioned at the operator's side of lower looper 12, is prevented from moving in the direction of arrow "B" in FIG. 5 by restrictor 13*a*. Needle thread 10*b*, positioned at the back side of lower looper 12, may move in the direction of arrow "B" in FIG. 5, but needle thread 10*b* is guided by thread chain guiding device 14 and is protected from hanging or catching on inner chain-off finger 2.

Figure 7:
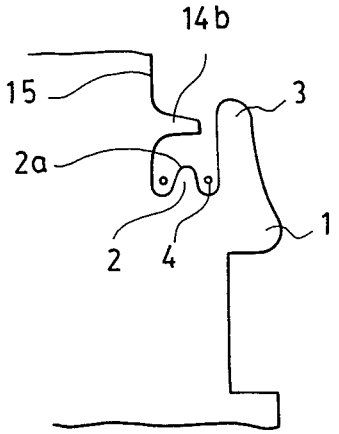
FIG. 7 is a plan view of the fourth embodiment of the present invention showing a thread chain guiding device.
Figure 8:
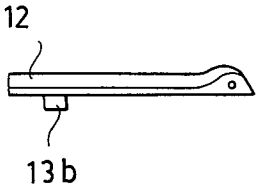
FIG. 8 is a plan view of another aspect of a needle thread restrictor according to the third and fourth embodiments of the present invention.

In the third embodiment, thread chain guiding device 14 is provided at side wall 15 of throat plate 1, but in the fourth embodiment of FIGS. 7 and 8, a projection 14*b* projects from side wall 15 of throat plate 1. Projection 13*b* is also provided on lower looper 12. The embodiment of FIGS. 7 and 8, with projections 13*b* and 14*b*, functions in the same manner as the third embodiment with guide 14*a* because projection 14*b* projects from the side of throat plate 1, close enough to prevent thread chain 5 from hanging at inner chain-off finger 2. It is to be appreciated that the fourth embodiment is the cheapest and the simplest way of preventing thread chain 5 from hanging or catching on inner chain-off finger 2.

Figure 9:
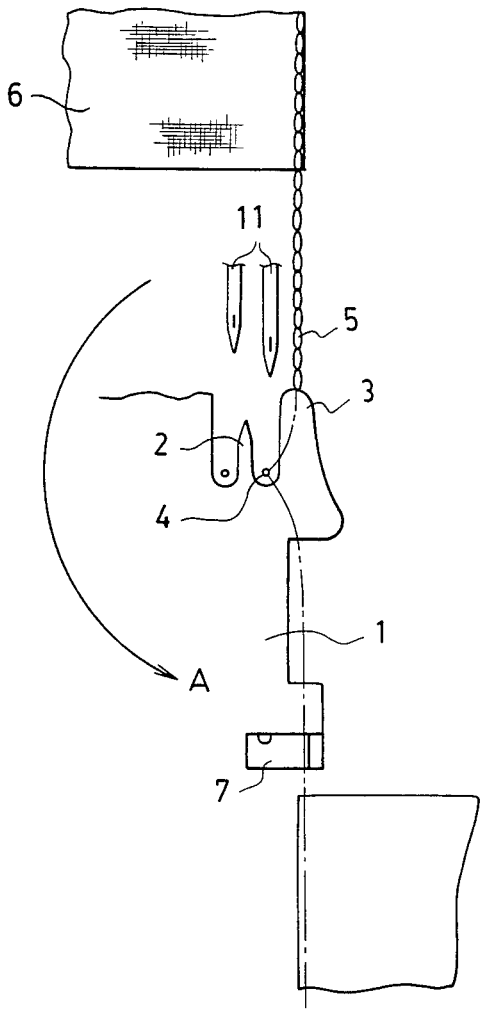
FIG. 9 PRIOR ART
FIG. 9 illustrates the turning back of a thread chain to the operator's side in a prior art thread chain guiding device.
Figure 10:
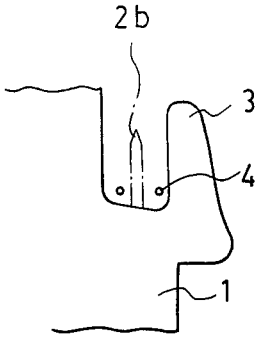
PRIOR ART FIG. 10
FIG. 10 illustrates a prior art throat plate with an inner chain-off finger in phantom.
Figure 11:
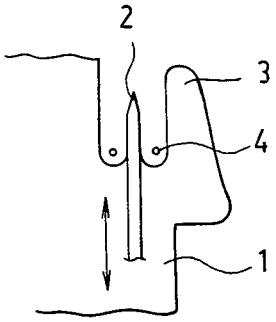
PRIOR ART FIG. 11
FIG. 11 illustrates a prior art throat plate with a retractable chain-off finger.

It is a well known general practice, as illustrated in the prior art mechanism of FIGS. 9 through 11, to provide an inner chain-off finger at the throat plate to protect the fabric material from sinking or dropping during stitching by two needles, and thus prevent the skipping of stitches, and to make sure the fabric material has a good hand or feel.

The prior art mechanism of FIG. 9 includes a throat plate 1, an inner chain-off finger 2, an outer chain-off finger 3, a drop point 4 of a right-side needle, a thread chain 5, and a fabric material 6 with the thread chain 5 enfolded or back tacked between the looper threads. A thread-chain-holding-and-cutting-device 7 clamps and cuts the thread chain that is pulled in the direction of feeding. "Soft chain," as noted before, means that the thread chain has a well-balanced needle thread and looper thread. When only the thread chain is formed, the thread tension adjuster regulates the supply of looper thread, thus properly balancing the thread chain with a proper supply of threads, and providing a "soft chain."

As described hereinbefore, according to the first and second embodiments, needle thread 10, which enfolds or back tacks thread chain 5, is guided by needle thread restrictor 13*a*. Thus, thread chain 5 is protected from being caught or hung on inner chain-off finger 2. It is to be appreciated that a mechanism in accord with the first and second embodiments of the present invention is simple and relatively low in cost.

According to the third and fourth embodiments of the present invention, movement of needle thread 10 positioned at the operator's side is restricted by needle thread restrictor 13*a*. It is to be noted that the needle thread positioned at the back side of the lower looper is guided by the thread chain guiding device located at the throat plate. Thus, the thread chain is prevented from being caught or hung on the inner chain-off finger. It is to be further noted that a mechanism in accord with the third and fourth embodiment is at least as simple and as low in cost as a mechanism in accord with the first and second embodiments.

While several embodiments of the present invention have been described in detail herein with reference to the accompanying drawings, various changes and modifications may be effected therein by one skilled in the art without departing from the spirit and scope of the invention as defined in the appended claims.

What is claimed is:

1. In an overedge sewing machine with an inner chain-off finger and a needle thread used for enfolding a thread chain, the improvement comprising needle thread restricting means for guiding said needle thread away from said inner chain-off finger whereby said needle thread avoids hanging on said finger; wherein said machine has a lower looper; and wherein said thread restricting means is located on said lower looper for catching said needle thread and restraining movement thereof.

2. The improvement of claim 1, wherein the thread restricting means includes a first projection on one side of said lower looper and a second projection on an opposite side of said lower looper from said first projection.

3. In an overedge sewing machine with an inner chain-off finger and a needle thread used for enfolding a thread chain, the improvement comprising needle thread restricting means for guiding said needle thread away from said inner chain-off finger whereby said needle thread avoids hanging on said finger; wherein said machine has a lower looper; and wherein said thread restricting means includes a finger-like restrictor positioned adjacent said lower looper for engaging said needle thread; wherein said finger-like restrictor has a tip for catching said needle thread between said tip and said lower looper and for restraining movement of said needle thread thereby.

* * * * *